US010885896B2

(12) United States Patent
Ku

(10) Patent No.: US 10,885,896 B2
(45) Date of Patent: Jan. 5, 2021

(54) REAL-TIME DETECTION OF FEEDFORWARD INSTABILITY

(71) Applicant: BOSE CORPORATION, Framingham, MA (US)

(72) Inventor: Emery M. Ku, Somerville, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/983,313

(22) Filed: May 18, 2018

(65) Prior Publication Data

US 2019/0355342 A1 Nov. 21, 2019

(51) Int. Cl.
*G10K 11/178* (2006.01)

(52) U.S. Cl.
CPC .. *G10K 11/17873* (2018.01); *G10K 11/17823* (2018.01); *G10K 11/17853* (2018.01); *G10K 2210/1081* (2013.01); *G10K 2210/3011* (2013.01); *G10K 2210/3027* (2013.01); *G10K 2210/3028* (2013.01); *G10K 2210/3044* (2013.01)

(58) Field of Classification Search
CPC ..... G10K 11/17873; G10K 11/17823; G10K 11/17853; G10K 2210/1081; G10K 2210/3011; G10K 2210/3027; G10K 2210/3028; G10K 2210/3044
USPC ..... 381/71.11, 71.6, 97
See application file for complete search history.

(56) References Cited

U.S. PATENT DOCUMENTS

| | | | | |
|---|---|---|---|---|
| 5,159,636 | A * | 10/1992 | Rogalski | H03G 7/002 704/500 |
| 6,118,878 | A | 9/2000 | Jones | |
| 8,155,334 | B2 | 4/2012 | Joho et al. | |
| 8,798,283 | B2 | 8/2014 | Gauger, Jr. et al. | |
| 2004/0101413 | A1* | 5/2004 | Inagaki | F04B 35/045 417/44.11 |
| 2005/0047620 | A1 | 3/2005 | Fretz | |
| 2010/0135483 | A1 | 6/2010 | Mohammad et al. | |
| 2011/0206226 | A1* | 8/2011 | Pandey | H04R 25/453 381/317 |

(Continued)

FOREIGN PATENT DOCUMENTS

| | | | |
|---|---|---|---|
| EP | 0814456 | A2 | 12/1997 |
| EP | 2106163 | A2 | 9/2009 |
| WO | 2004105430 | A1 | 12/2004 |

OTHER PUBLICATIONS

Berners, Allpass Filter, 2017.*
International Search Report and Written Opinion dated Aug. 5, 2019 for International Application No. PCT/US2019/032425.

*Primary Examiner* — William A Jerez Lora

(57) ABSTRACT

Audio devices and methods are provided for detecting instability in an associated feedforward audio processing system. A microphone provides a feedforward signal for processing by a feedforward filter. The processed signal may provide noise reduction and/or sound enhancement associated with the surrounding environment. The processed signal contributes to a driver signal provided to an acoustic transducer, e.g., a driver, to produce acoustic signals for a user. A processor is configured to detect an indication of instability in one or more of the signals, and to adjust a phase response of the feedforward signal path in response to detecting the indication of instability.

20 Claims, 6 Drawing Sheets

(56) References Cited

U.S. PATENT DOCUMENTS

| | | | | |
|---|---|---|---|---|
| 2011/0243343 | A1* | 10/2011 | Gauger, Jr. ..... | G10L 21/0208<br>381/71.6 |
| 2012/0057720 | A1 | 3/2012 | Van Leest | |
| 2016/0125866 | A1 | 5/2016 | Park et al. | |
| 2017/0110106 | A1 | 4/2017 | Kumar et al. | |
| 2017/0365245 | A1 | 12/2017 | Ku | |

* cited by examiner

REAL-TIME DETECTION OF FEEDFORWARD INSTABILITY

BACKGROUND

Audio headphone, earphone, headset systems, and other personal audio devices are used in various environments for purposes such as entertainment, communications, and professional applications. Many systems incorporate active noise reduction (ANR) features, also known as active noise cancellation (ANC), in which one or more microphones detect sound, such as exterior acoustics captured by a feedforward microphone or interior acoustics captured by a feedback microphone. In some examples, signals from a feedforward microphone may be processed to provide anti-noise signals to be fed to an acoustic transducer (e.g., a speaker, driver) to counteract noise, and may also be processed to enhance sounds, e.g., to improve a user's awareness of his/her surroundings, to improve hearing generally, or to improve sounds that may otherwise be difficult to hear by a user. The feedforward microphone may at times pick up acoustic signals produced by the driver, thereby forming a closed loop system that may become unstable at times.

Similarly, various audio systems that provide an amplified signal to a speaker, from a microphone, such as public address systems and studio recording or performance venue audio systems, may exhibit instability when the microphone picks up acoustic signals produced by the speaker. While such may generally be referred to as "feedback," and in particular a signature "squeal" from such a condition is often termed "feedback," such is an issue of feedforward instability, caused by an unintended or undesired feedback loop (e.g., signal fed back from the speaker or driver to the microphone).

In various situations it is therefore desirable to detect when a condition of feedforward instability exists.

SUMMARY OF THE INVENTION

Aspects and examples are directed to audio systems and methods that detect instability in a feedforward signal path. The systems and methods operate to detect a possible instability (for example, by detecting a tonal signature) and, when detected, to adjust a phase response of a feedforward signal path (e.g., from a feedforward microphone to a driver signal), e.g., to alter the instability. If the instability detection, e.g., the tonal signature, responds to the adjusted phase response, such may indicate or confirm that a feedforward instability exists.

According to one aspect, an audio device is provided that includes a microphone to provide a first signal, a processor comprising a filter, the processor configured to receive the first signal and provide a second signal, the second signal based at least in part upon processing the first signal using the filter, and an acoustic transducer to convert a third signal, based at least in part upon the second signal, into an acoustic signal, wherein the processor is also configured to detect an indication of instability in any of the first signal, the second signal, or the third signal and to adjust a phase response of the filter in response to detecting the indication of instability.

In some examples, the processor is further configured to confirm an instability by monitoring for a change in the indication of instability resulting from adjusting the phase response of the filter. In certain examples, the processor also adjusts one or more parameters involved in providing the second signal in response to confirming the instability, to mitigate an impact of the instability.

According to various examples, the processor is configured to detect the indication of instability by detecting a tonal signature in any of the first signal, the second signal, or the third signal. The processor may be further configured to determine whether the tonal signature changes in response to adjusting the phase response of the filter and to confirm an instability upon a determination that the tonal signature changed in response to adjusting the phase response of the filter. In certain examples the change in tonal signature is a change in at least one of an amplitude of the tonal signature or a rate of rise or fall of the amplitude of the tonal signature. In various examples, the tonal signature comprises components within a predetermined frequency range. In some examples, the predetermined frequency range is substantially between 1 KHz and 6 KHz. In further examples, the predetermined frequency range may be substantially between 3 KHz and 6 KHz.

According to another aspect, a method of detecting feedforward instability in an audio device is provided. The method includes monitoring for a potential instability in a feedforward signal path, adjusting a phase response of the feedforward signal path in response to detecting a potential instability in the feedforward signal path, monitoring for a change in the potential instability, the change resulting from the adjusted phase response, and confirming that a feedforward instability exists based upon a detected change in the potential instability.

In some examples, adjusting the phase response comprises shifting an inflection point in the phase response.

In various examples, monitoring for a potential instability comprises monitoring for a tonal signature. In some examples, monitoring for a change in the potential instability comprises monitoring for a change in at least one of an amplitude of the tonal signature or a rate of rise or fall of the amplitude of the tonal signature. The tonal signature may comprise components within a predetermined frequency range, and in some examples the predetermined frequency range is substantially between 1 KHz and 6 KHz. In further examples, the predetermined frequency range may be substantially between 3 KHz and 6 KHz.

Certain examples include adjusting one or more parameters of the feedforward signal path in response to confirming that the feedforward instability exists.

According to another aspect, a headphone system is provided that includes an earpiece having a feedforward microphone configured to detect external acoustic signals and to provide a feedforward signal, a feedforward processor to process the feedforward signal to provide a feedforward driver component signal, an acoustic transducer to produce acoustic signals based upon a driver signal, the driver signal based at least in part upon the feedforward driver component signal, an instability detector configured to monitor for a signal indicative of an unstable closed loop between the acoustic transducer and the feedforward microphone, and a phase adjuster configured to adjust a phase of a transfer function associated with the feedforward processor in response to detecting the signal indicative of an unstable closed loop between the acoustic transducer and the feedforward microphone.

In some examples the feedforward processor is configured to apply the transfer function to the feedforward signal.

According to various examples, the instability detector is configured to monitor for a tonal signature indicative of an unstable closed loop between the acoustic transducer and the feedforward microphone. In certain examples, the instability detector may be further configured to monitor for a change in the tonal signature in response to the adjusted phase of the transfer function and to confirm the unstable closed loop based upon a determination that the tonal signature changed in response to the adjusted phase. In some examples, the change in the tonal signature is a change in at least one of an amplitude of the tonal signature or a rate of rise or fall of the amplitude of the tonal signature.

In certain examples, the feedforward processor is further configured to adjust a parameter of the feedforward processing to mitigate the unstable closed loop in response to a confirmation of the unstable closed loop.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by identical or similar numerals. For purposes of clarity, not every component may be labeled in every figure. In the figures.

DETAILED DESCRIPTION

Figure 1:
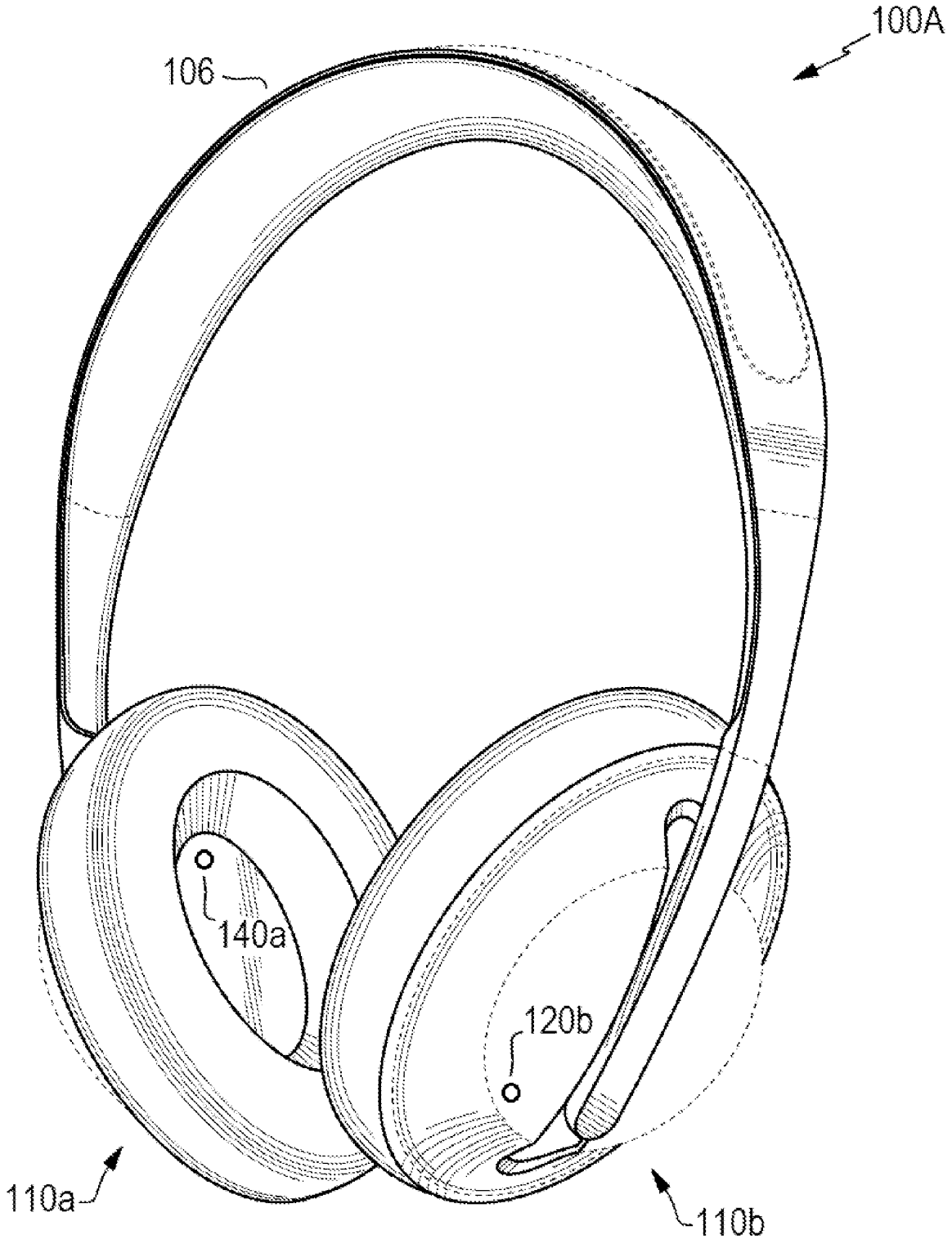
FIG. 1 is a perspective view of one example headset form factor.

Aspects of the present disclosure are directed to audio systems that include feedforward signal processing, such as sound enhancing and/or noise cancelling headphones or headsets, and methods that detect instability in the feedforward system. Noise cancelling systems operate to reduce acoustic noise components heard by a user, e.g., wearer, of the headset. Noise cancelling systems may include feedforward and/or feedback characteristics. A feedforward component detects noise external to the headset (e.g., via an external microphone) and acts to provide an anti-noise signal to counter the external noise expected to be transferred through to the user's ear. A feedback component detects acoustic signals reaching the user's ear (e.g., via an internal microphone) and processes the detected signals to counteract any signal components not intended to be part of the user's acoustic experience. Examples disclosed herein may be coupled to, or placed in connection with, other systems, through wired or wireless means, or may be independent of any other systems or equipment.

The systems and methods disclosed herein may include or operate in, in some examples, an aviation headset, a telephone headset, media headphones, network gaming headphones, hearing assistance headphones, hearing aids, or any combination of these or others. Throughout this disclosure the terms "headset," "headphone," "earphone," and "headphone set" are used interchangeably, and no distinction is meant to be made by the use of one term over another unless the context clearly indicates otherwise. Additionally, aspects and examples in accord with those disclosed herein are applicable to various form factors, such as in-ear transducers or earbuds and on-ear or over-ear headphones, and others. Any suitable form factor is therefore contemplated by the terms "headset," "headphone," and "headphone set" as used herein.

Examples disclosed may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

For various components described herein, a designation of "a" or "b" in the reference numeral may be used to indicate "right" or "left" versions of one or more components. When no such designation is included, the description is without regard to the right or left and is equally applicable to either of the right or left, which is generally the case for the various examples described herein. Additionally, aspects and examples described herein are equally applicable to monaural or single-sided personal acoustic devices and do not necessarily require both of a right and left side.

Figure 2:
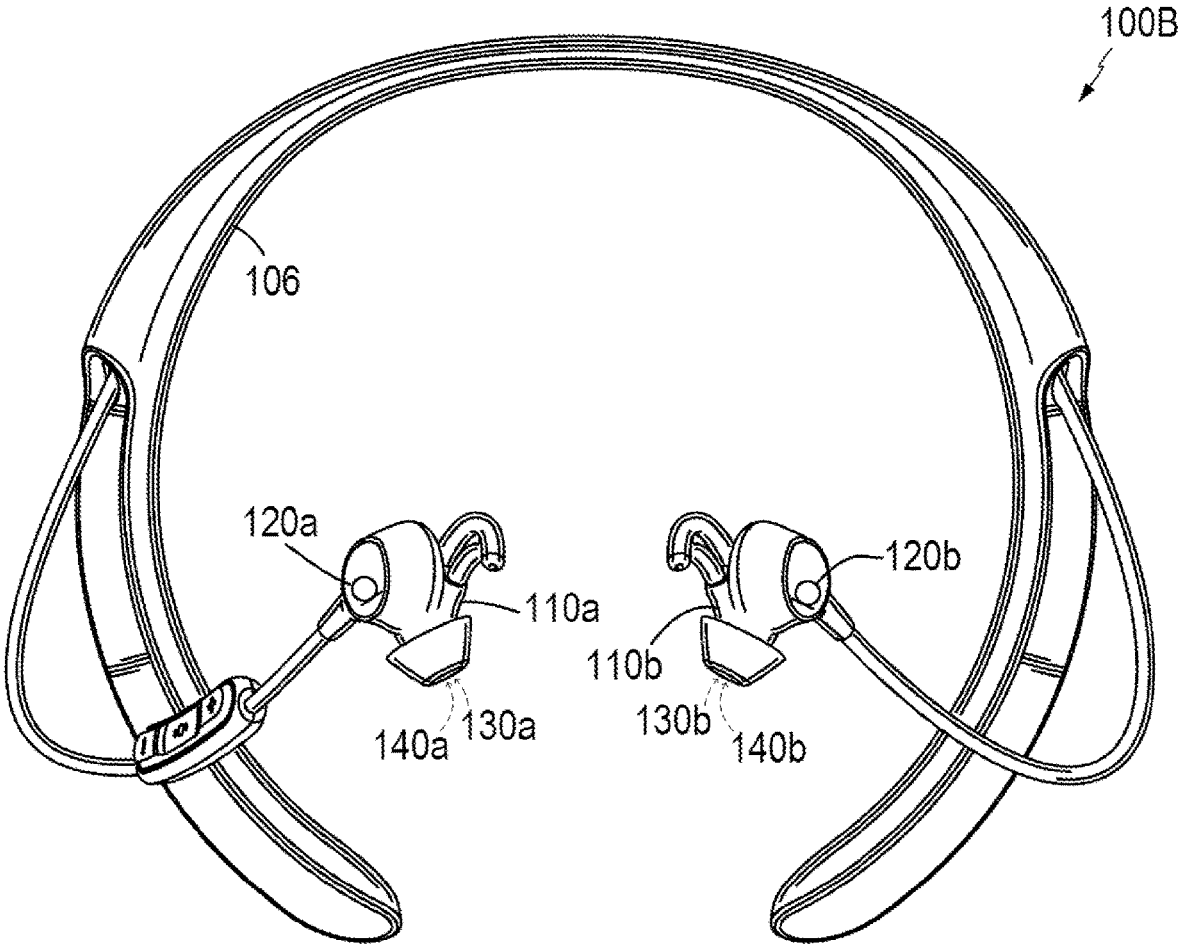
FIG. 2 is a perspective view of another example headset form factor.

FIGS. 1 and 2 illustrate two example headsets 100A, 100B. Each headset 100 includes a right earpiece 110*a* and a left earpiece 110*b*, intercoupled by a supporting structure 106 (e.g., a headband, neckband, etc.) to be worn by a user. In some examples, two earpieces 110 may be independent of each other, not intercoupled by a supporting structure. Each earpiece 110 may include one or more microphones, such as a feedforward microphone 120 and/or a feedback microphone 140. The feedforward microphone 120 may be configured to sense acoustic signals external to the earpiece 110 when properly worn, e.g., to detect acoustic signals in the surrounding environment before they reach the user's ear. The feedback microphone 140 may be configured to sense acoustic signals internal to an acoustic volume formed with the user's ear when the earpiece 110 is properly worn, e.g., to detect the acoustic signals reaching the user's ear. Each earpiece also includes a driver 130, which is an acoustic transducer for conversion of, e.g., an electrical signal, into an acoustic signal that the user may hear. In various examples, one or more drivers may be included in an earpiece, and an earpiece may in some cases include only a feedforward microphone or only a feedback microphone.

While the reference numerals 120 and 140 are used to refer to one or more microphones, the visual elements illustrated in the figures may, in some examples, represent an acoustic port wherein acoustic signals enter to ultimately reach such microphones, which may be internal and not physically visible from the exterior. In examples, one or more of the microphones 120, 140 may be immediately adjacent to the interior of an acoustic port, or may be removed from an acoustic port by a distance, and may include an acoustic waveguide between an acoustic port and an associated microphone.

Figure 3:
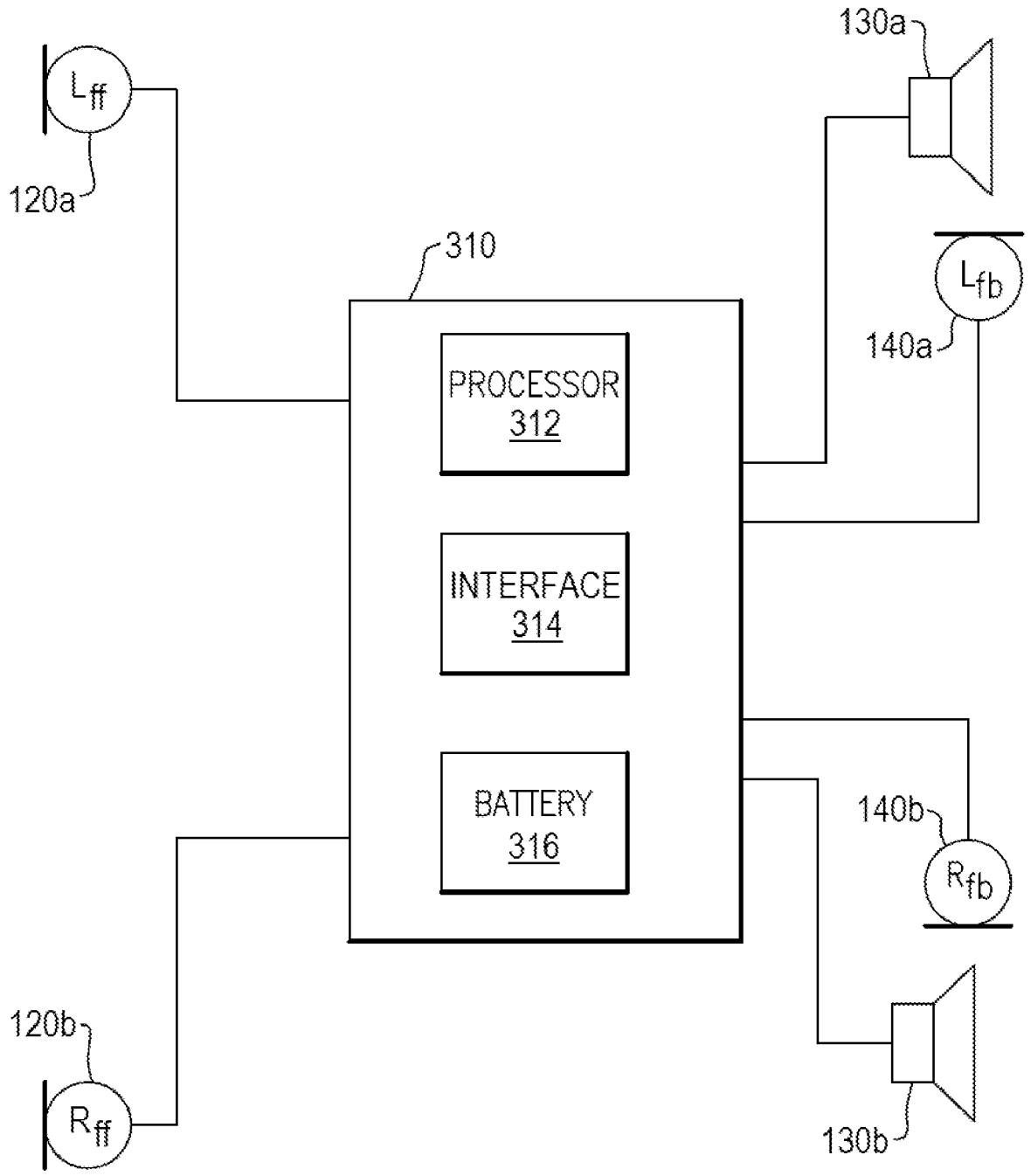
FIG. 3 is a schematic block diagram of example audio processing that may be incorporated into various audio systems.

Shown in FIG. 3 is an example of a processing unit 310 that may be physically housed somewhere on or within the headset 100. The processing unit 310 may include a processor 312, an audio interface 314, and a battery 316. The processing unit 310 may be coupled to one or more feedforward microphone(s) 120, driver(s) 130, and/or feedback microphone(s) 140, in various examples. In various examples, the interface 314 may be a wired or a wireless interface for receiving audio signals, such as a playback audio signal or program content signal, and may include further interface functionality, such as a user interface for receiving user inputs and/or configuration options. In various examples, the battery 316 may be replaceable and/or rechargeable. In various examples, the processing unit 310 may be powered via means other than or in addition to the battery 316, such as by a wired power supply or the like. In some examples, a system may not include an interface 314 to receive a playback signal.

Figure 4:
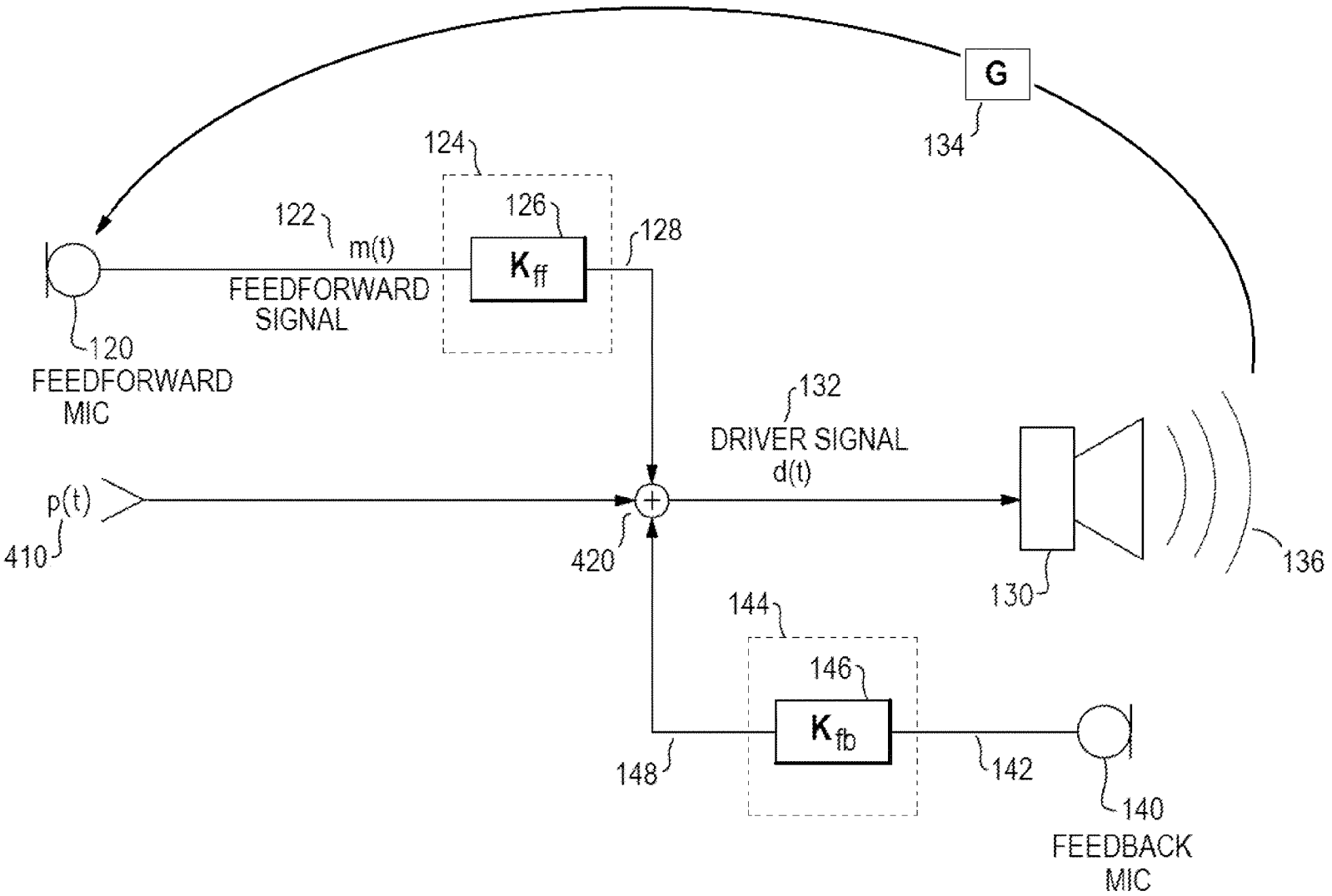
FIG. 4 is a schematic diagram of an example audio system incorporating feedforward and feedback components.

FIG. 4 illustrates a system and method of processing microphone signals to provide sound to the user's ear, whether for noise reduction or for sound enhancement. FIG. 4 presents a simplified schematic diagram to highlight features of such an audio system. Various examples of a complete system may include amplifiers, analog-to-digital conversion (ADC), digital-to-analog conversion (DAC), equalization, sub-band separation and synthesis, and other signal processing or the like. In some examples, a playback signal 410, p(t), may be received to be rendered as an acoustic signal by the driver 130. The feedforward microphone 120 may provide a feedforward signal 122 that is processed by a feedforward processor 124, having a feedforward transfer function 126, $K_{ff}$, to produce a feedforward driver component signal 128, which may be an anti-noise signal or may be an enhanced sound signal, or a combination of the two. The feedback microphone 140 may provide a feedback signal 142 that is processed by a feedback processor 144, having a feedback transfer function 146, $K_{fb}$, to produce a feedback anti-noise signal 148. In various examples, any of the playback signal 410, the feedforward driver component signal 128, and/or the feedback anti-noise signal 148 may be combined, e.g., by a combiner 420, to generate a driver signal 132, d(t), to be provided to the driver 130. In various examples, any of the playback signal 410, the feedforward driver component signal 128, and/or the feedback anti-noise signal 148 may be omitted and/or the components necessary to support any of these signals may not be included in a particular implementation of a system.

Various examples described herein include a feedforward audio system, e.g., a feedforward microphone 120 and a feedforward processor 124, e.g., to provide a feedforward driver component signal 128 for inclusion in a driver signal 132. The feedforward microphone 120 may be configured to detect external sound before it reaches an acoustic volume that includes the user's ear. Nonetheless, the feedforward microphone 120 may detect an acoustic signal 136 produced by the driver 130, such that a closed loop exists. For example, the feedforward microphone 120 may pick up the acoustic signal 136 when the headset 100 is played at a high volume, when the headset 100 is not being worn (e.g., off-head, reduces physical isolation between the driver 130 and the feedforward microphone 120), or when the feedforward signal 122 is purposefully processed to enhance or improve external sounds rather than reduce them (e.g., amplified to hear through the earpiece), or various other conditions.

Accordingly, in various examples and/or at various times, a feedforward signal path may include a feedback loop (e.g., a closed feedforward loop) going, e.g., from the driver signal 132 through the driver 130 producing the acoustic signal 136, which may reach and be picked up by the feedforward microphone 120, and processed through the feedforward transfer function 126, $K_{ff}$, to be included back into the driver signal 132. Accordingly, at least some components of the feedforward signal 122 may be caused by the acoustic signal 136. Alternately stated, the feedforward signal 122 may include components related to the driver signal 132. If the closed loop exhibits an instability, such may cause at least one frequency component of the driver signal 132 to progressively increase in amplitude. This may be perceived by the user as an audible artifact, such as a tone or squealing, and may reach a limit at a maximum amplitude the driver 130 is capable of producing, which may be extremely loud. Accordingly, when such a condition exists, the feedforward system may be described as unstable.

The electrical and physical system shown in FIG. 4 exhibits a transfer function 134, G, characterizing the transfer of the driver signal 132 through to the feedforward signal 122. In other words, the response of the feedforward signal 122 to the driver signal 132 is characterized by the transfer function 134, G. The system of the feedforward noise reduction loop is therefore characterized by the combined transfer function $GK_{ff}$. The feedforward noise reduction system may be unstable if $GK_{ff}=1$ for one or more frequencies. In various examples, the transfer function 134, G, is typically small (e.g., $G<<1$), but (as discussed above) various situations may cause the transfer function 134, G, to be larger than typical, and in various situations or user configurations the feedforward transfer function 126, $K_{ff}$, may be larger than typical (e.g., $K_{ff}>>1$) (such as when the headset is used to amplify some external sounds), either of which may yield an instability at one or more frequencies.

In various examples, a feedforward instability may be detected by various means. In at least one example, a processing system may monitor any of the feedforward signal 122, the feedforward driver component signal 128, the driver signal 132, and/or other signals for a tonal signature. For example, an instability may cause one or more tones to rise (in amplitude, in signal energy) above an expected, average, or base level of various components of any of the above-mentioned signals, and the rising tone may be detected by various means. In various examples, a tonal signature may fall in a range of 1 kHz to 8 kHz, or in a range of 3 kHz to 6 kHz, or other ranges, and may depend upon the size and scale of the system (e.g., over-ear headphones versus in-ear earphones). Further details of detecting a tonal signature of instability, such as a rising tone, are included in U.S. Pat. No. 9,922,636 titled MITIGATION OF UNSTABLE CONDITIONS IN AN ACTIVE NOISE CONTROL SYSTEM, which is incorporated herein by reference in its entirety for all purposes. Various examples may use such instability detection, or others, and may further use systems and methods in accord with aspects and examples described herein to confirm that the instability detection is correct and not a false positive (e.g., detecting an instability when an instability does not actually exist).

Aspects and examples described herein adjust the feedforward signal path, e.g., by phase variation, which may confirm the instability detection. For example, if a tonal signature of an instability remains unchanged in spite of an adjusted feedforward signal path, the tonal signature may be due to an external sound and not an instability. If a tonal signature responds to an adjusted feedforward signal path, the tonal signature may be due to an instability, and such may be a basis to confirm the instability detection. Accordingly, in various examples, a system or method of detecting an instability may use one or more of various adjusted phase responses in the signal path (in accord with those described herein), and may require that the detection system or method react to the adjusted phase response (e.g., move closer to or further from stability as a result of the adjusted phase response) to confirm detection, thereby reducing false positives.

Figure 5:
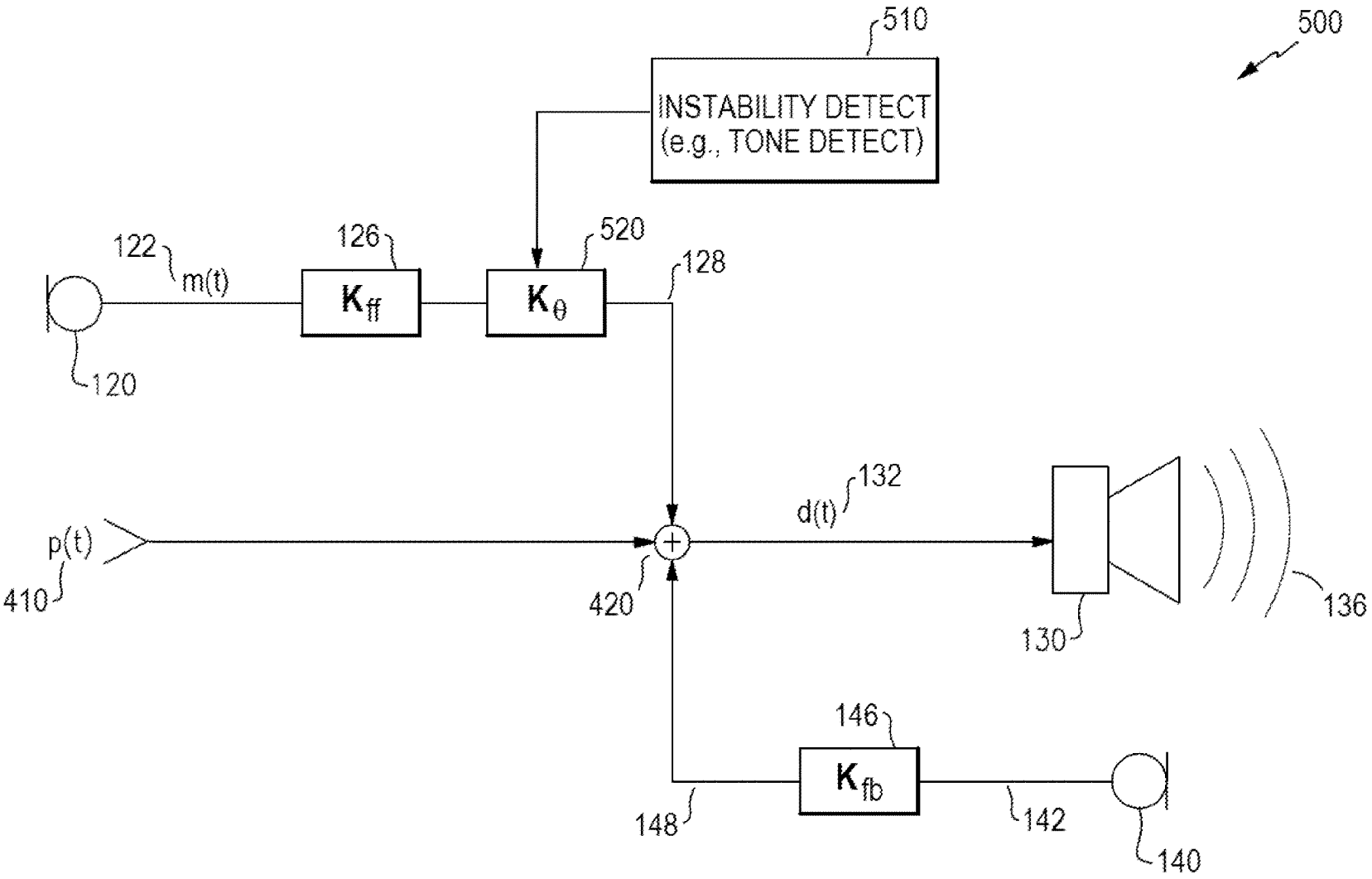
FIG. 5 is a schematic diagram of an example system for instability detection and confirmation.

FIG. 5 illustrates an example system 500 that includes a detector 510 to detect signs of feed-forward instability, which may be any of various types of detection, such as detection of a tonal signature as discussed above. If the detector 510 detects an instability, a phase adjuster 520 may adjust a phase response of the feedforward signal path, thus altering the driver component signal 128 in certain examples. In various examples, the phase adjuster 520 may be an all-pass filter (e.g., unity gain at all frequencies of interest) with a phase response that causes various frequencies to emerge from the filter with altered phase. In other examples, the phase adjuster 520 may be a delay block that adds a delay, effectively phase shifting all the frequencies. For example, a delay block may provide a delay of tens or hundreds of microseconds, such as 125 μsec, or 250 μsec, for example. For example, a 125 μsec delay may cause a phase shift of 45° at 1 kHz, a shift of 90° at 2 kHz, and a shift of 180° at 4 kHz, etc. In yet other examples, the phase adjuster 520 may be incorporated in the feedforward processor 124, e.g., by adding the phase adjuster 520 before or after the feedforward transfer function 126 and/or by altering the feedforward transfer function 126 in response to the detector 510 indicating a detected instability. In various examples, a phase shift (e.g., by a phase adjuster 520) may be provided at any of various positions of the feedforward signal path, such as after the combiner 420, e.g., acting on the driver signal 132, for instance.

Adjusting a phase response of the feedforward signal path (e.g., by a phase adjuster 520) may alter or change an instability in the feedforward signal path, and thereby alter a detected indication of instability. Accordingly, the phase adjuster 520 may be advantageously applied to confirm an instability detection. For example, the detector 510 may monitor for various symptoms (indicators) of instability (e.g., a tonal signature), and when detected, the phase adjuster 520 may be activated to adjust phase response of the feedforward signal path. If the symptom of instability responds to the adjusted phase response, such as by a tonal signature increasing or decreasing (e.g., in amplitude or frequency), or a rate of change of the tonal signature increases or decreases, such may confirm that an instability exists and is not a false positive. In an example case of a false positive, an external sound may trigger the detector 510 to indicate a potential instability, and such may be a false positive, but adjusting the phase response of the feedforward signal path (e.g., by a phase adjuster 520) does not alter the external sound source. Accordingly, the symptom (external sound) detected by the detector 510 remains unchanged in response to the phase adjustment, thus the detector 510 (or other processing) may determine that the detected symptom is a false positive indicator of instability, and that no actual instability exists.

While FIG. 5 and the above description are directed to making phase adjustment in a feedforward signal path to confirm detection of a feedforward instability, a phase adjustment may equally be placed in a feedback signal path to detect (or confirm) instability of a feedback noise reduction system, in similar fashion.

Figure 6:
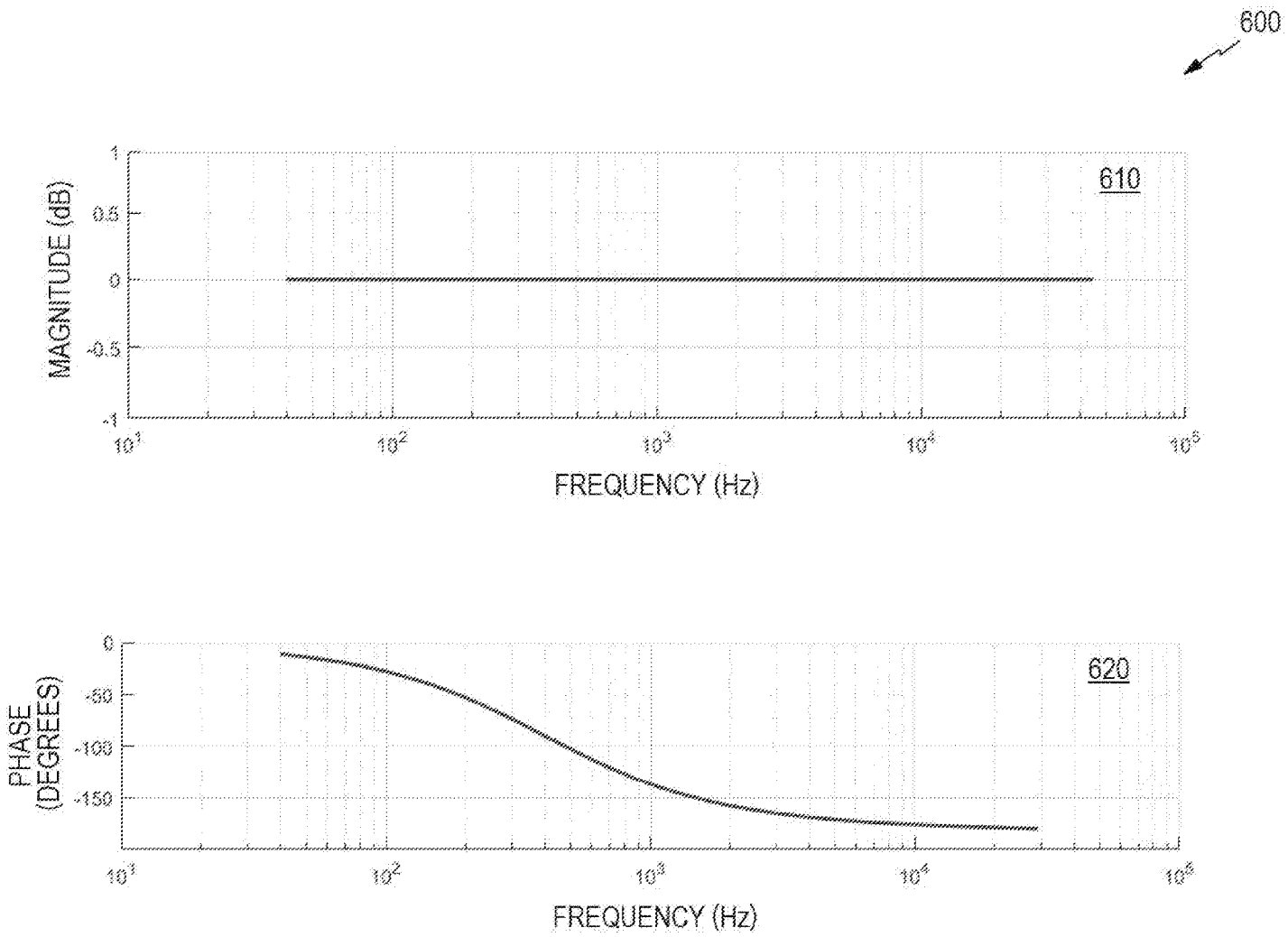
FIG. 6 is a schematic diagram of an example filter response for phase adjustment.

FIG. 6 illustrates an example response 600 (e.g., transfer function) of a phase adjuster 520. The magnitude response 610 is unity (Gain=1.0x, 0 dB) and the phase response 620 adjusts a range of frequencies through various phase shifts. In some examples, the phase adjuster 520 may be configured so the phase response 620 shifts the phase of only a range of frequencies, such as a range of frequencies where a tonal signature of an instability may be expected. The phase response 620 is only one example of a suitable phase response of a phase adjuster 520. In various examples, the phase adjuster 520 may shift the phase of a range of frequencies by a fixed amount (e.g., the phase response 620 may be a straight horizontal line at a non-zero phase value), or may shift timing of all frequencies by a fixed delay (e.g., the phase response 620 may be a straight inclined line without curvature), or may shift the phase response in various other ways. In some examples, the phase adjuster 520 may be implemented as a modification of the feedforward transfer function 126, which itself has a baseline phase response. Accordingly, the phase adjuster 520 may be implemented as a shift in the baseline phase response of the feedforward transfer function 126. For example, the feedforward transfer function 126 may have a phase response similar to that shown in FIG. 6 (for illustrative purposes) and a phase adjustment may be applied by shifting phase response of the feedforward transfer function 126, such as by shifting an inflection point, or other alteration of the phase response of the feedforward transfer function 126. In some examples, an indication from the detector 510 may be applied as a command to the feedforward processor 124 to make such a shift or alteration to a phase response of the feedforward transfer function 126.

When the detector 510 indicates that a potential feedforward instability is detected, and is confirmed by response to the phase adjuster 520, various systems and methods in accord with aspects and examples herein may take varying actions in response to the instability, e.g., to mitigate or remove the instability and/or the undesirable consequences of the instability. For example, an audio system in accord with those described may alter or replace the feedforward transfer function 126, alter a feedforward controller or feedforward processor 124, change to a less aggressive form of feedforward gain or other processing, alter various parameters of the feedforward system to be less aggressive, alter a driver signal (e.g., mute, reduce, or limit the driver signal 132), provide an indicator to a user (e.g., an audible or visual message, an indicator light, etc.), and/or other actions.

The above described aspects and examples provide numerous potential benefits to a personal audio device that includes feedforward noise reduction. Stability criteria for feedforward control may be defined by an engineer at the controller design stage, and various considerations assume a limited range of variation (of system characteristics) over the lifetime of the system. For example, driver output and microphone sensitivity may vary over time and contribute to the electroacoustic transfer function between the driver and the feedforward microphone. Further variability may impact design criteria, such as production variation, head-to-head variation, variation in user handling, and environmental factors. Any such variations may cause stability constraints to be violated, and designers must conventionally take a conservative approach to feedforward system design to ensure that instability is avoided. Such an instability may cause the noise reduction system to add undesired signal components rather than reduce them, thus conventional design practices may take highly conservative approaches to avoid an instability occurring, potentially at severe costs to system performance.

However, aspects and examples of detecting feedforward instability, as described herein, allow corrective action to be taken to remove the instability when such condition occurs, allowing system designers to design systems that operate under conditions nearer to a boundary of instability, and thus achieve improved performance over a wider feedforward bandwidth. Aspects and examples herein allow reliable detection if or when the instability boundary is crossed. Conventional systems need to be designed to avoid instability, but instability detection in accord with aspects and examples described herein allow the feedforward controller or processor to be designed with relaxed constraints, and resulting improved performance. Accordingly, systems and methods herein may more than double the range of bandwidth in which noise reduction by a feedforward processor may be effective.

In various examples, any of the functions of the systems and methods described herein may be implemented or carried out in a digital signal processor (DSP), a microprocessor, a logic controller, logic circuits, and the like, or any combination of these, and may include analog circuit components and/or other components with respect to any particular implementation. Functions and components disclosed herein may operate in the digital domain and certain examples include analog-to-digital (ADC) conversion of analog signals generated by microphones, despite the lack of illustration of ADC's in the various figures. Such ADC functionality may be incorporated in or otherwise internal to a signal processor. Any suitable hardware and/or software, including firmware and the like, may be configured to carry out or implement components of the aspects and examples disclosed herein, and various implementations of aspects and examples may include components and/or functionality in addition to those disclosed.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. An audio device comprising:

a microphone to provide a first signal;

a processor comprising a filter, the processor configured to receive the first signal and provide a second signal, the second signal based at least in part upon processing the first signal using the filter, the second signal being an anti-noise signal; and an acoustic transducer to convert a third signal, based at least in part upon the second signal, into an acoustic signal, the third signal being a driver signal;

wherein the processor is also configured to detect an indication of instability in any of the first signal, the second signal, or the third signal and to adjust a phase response of a feedforward signal path by shifting at least one of a timing or phase of a range of frequencies at unity gain in response to detecting the indication of instability.

2. The audio device of claim 1 wherein the processor is further configured to confirm an instability by monitoring for a change in the indication of instability resulting from adjusting the phase response of the feedforward signal path.

3. The audio device of claim 2 wherein the processor is further configured to adjust one or more parameters involved in providing the second signal in response to confirming the instability, to mitigate an impact of the instability.

4. The audio device of claim 1 wherein the processor is configured to detect the indication of instability by detecting a tonal signature in any of the first signal, the second signal, or the third signal.

5. The audio device of claim 4 wherein the processor is further configured to determine whether the tonal signature changes in response to adjusting the phase response of the feedforward signal path and to confirm an instability upon a determination that the tonal signature changed in response to adjusting the phase response of the feedforward signal path.

6. The audio device of claim 5 wherein the change in tonal signature is a change in at least one of an amplitude of the tonal signature or a rate of rise or fall of the amplitude of the tonal signature.

7. The audio device of claim 4 wherein the tonal signature comprises components within a predetermined frequency range.

8. The audio device of claim 7 wherein the predetermined frequency range is substantially between 1 KHz and 6 KHz.

9. A method of detecting feedforward instability in an audio device, the method comprising:

monitoring for a potential instability in a feedforward signal path;

adjusting a phase response of the feedforward signal path by shifting at least one of a timing or phase of a range of frequencies at unity gain in response to detecting a potential instability in the feedforward signal path;

monitoring for a change in the potential instability, the change resulting from the adjusted phase response; and confirming that a feedforward instability exists based upon a detected change in the potential instability.

10. The method of claim 9 wherein adjusting the phase response comprises shifting an inflection point in the phase response.

11. The method of claim 9 wherein monitoring for a potential instability comprises monitoring for a tonal signature.

12. The method of claim 11 wherein monitoring for a change in the potential instability comprises monitoring for a change in at least one of an amplitude of the tonal signature or a rate of rise or fall of the amplitude of the tonal signature.

13. The method of claim 12 wherein the tonal signature comprises components within a predetermined frequency range.

14. The method of claim 13 wherein the predetermined frequency range is substantially between 1 kHz and 6 kHz.

15. The method of claim 9 further comprising adjusting one or more parameters of the feedforward signal path in response to confirming that the feedforward instability exists.

16. A headphone system comprising;

an earpiece having a feedforward microphone configured to detect external acoustic signals and to provide a feedforward signal;

a feedforward processor to process the feedforward signal to provide a feedforward driver component signal;

an acoustic transducer to produce acoustic signals based upon a driver signal, the driver signal based at least in part upon the feedforward driver component signal;

an instability detector configured to monitor for a signal indicative of an unstable closed loop between the acoustic transducer and the feedforward microphone; and a phase adjuster configured to adjust a phase of a transfer function associated with the feedforward processor by shifting at least one of a timing or phase of a range of frequencies at unity gain in response to detecting the signal indicative of an unstable closed loop between the acoustic transducer and the feedforward microphone.

17. The headphone system of claim 16 wherein the feedforward processor is configured to apply the transfer function to the feedforward signal.

18. The headphone system of claim 16 wherein the instability detector is configured to monitor for a tonal signature indicative of an unstable closed loop between the acoustic transducer and the feedforward microphone.

19. The headphone system of claim 18 wherein the instability detector is further configured to monitor for a change in the tonal signature in response to the adjusted phase of the transfer function and to confirm the unstable closed loop based upon a determination that the tonal signature changed in response to the adjusted phase.

20. The headphone system of claim 19 wherein the change in the tonal signature is a change in at least one of an amplitude of the tonal signature or a rate of rise or fall of the amplitude of the tonal signature.

* * * * *